United States Patent [19]

Fender et al.

[11] Patent Number: 4,770,965

[45] Date of Patent: Sep. 13, 1988

[54] SELENIUM ALLOY IMAGING MEMBER

[75] Inventors: William D. Fender, Pasadena; Robert C. Speiser, Altadena; Gerhard K. Kramer, Monrovia; Hans P. Ceelen, Upland, all of Calif.

[73] Assignee: Xerox Corporation, Stamford, Conn.

[21] Appl. No.: 946,238

[22] Filed: Dec. 23, 1986

[51] Int. Cl.[4] ..... G03G 5/082

[52] U.S. Cl. ..... 430/66; 430/86; 430/128

[58] Field of Search ..... 430/66, 86, 58, 128

[56] References Cited

U.S. PATENT DOCUMENTS

| | | | |
|---|---|---|---|
| 3,394,001 | 7/1968 | Makino | 430/58 |
| 3,906,228 | 9/1975 | Lange | 430/86 |
| 3,973,960 | 8/1976 | Dulken et al. | 430/85 |
| 4,008,082 | 2/1977 | Beschoner et al. | 430/128 |
| 4,011,079 | 3/1977 | Berle et al. | 430/128 |
| 4,098,655 | 7/1978 | Ward et al. | 204/38.3 |
| 4,126,457 | 11/1978 | Ciuffini | 430/86 |
| 4,277,551 | 7/1981 | Sonnonstine et al. | 430/120 |
| 4,298,671 | 11/1981 | Kassel et al. | 430/128 |

OTHER PUBLICATIONS

W. D. Fender, "Quantification of the Xeroradiographic Discharge Curve", SPIE, vol. 70, (1975) 364.

L. S. Jerome et al., "Process Studies on Higher Sensitivity Xeromammography", SPIE, vol. 555.

R. C. Speiser et al., "Dose Comparisons for Mammographic Systems", Med. Phys., 13(5), Sep./Oct. 1986, 667.

*Primary Examiner*—John L. Goodrow

*Attorney, Agent, or Firm*—Peter H. Kondo

[57] ABSTRACT

An electrophotographic imaging member comprising providing a conductive substrate, an alloy layer comprising selenium doped with arsenic having a thickness of between about 100 micrometers and about 400 micrometers, the alloy layer comprising between about 0.3 percent and about 2 percent by weight arsenic at the surface of the alloy layer facing away from the conductive substrate and comprising crystalline selenium having a thickness of from about 0.01 micrometer to about 1 micrometer contiguous to the conductive substrate, and a thin protective overcoating layer on the alloy layer, the overcoating layer having a thickness between about 0.05 micrometer and about 0.3 micrometer and comprising from about 0.5 percent to about 3 percent by weight nigrosine. This photoreceptor is prepared by providing a conductive substrate, cleaning the substrate, heating an alloy comprising selenium and from about 0.05 percent to about 2 percent by weight arsenic until from about 2 percent to about 90 percent by weight of the selenium in the alloy is crystallized, vacuum depositing the alloy on the substrate to form a vitreous photoconductive insulating layer having a thickness of between about 100 micrometers and about 400 micrometers containing between about 0.3 percent and about 2 percent by weight arsenic at the surface of the photoconductive insulating layer facing away from the conductive substrate, applying thin protective overcoating layer on the photoconductive insulating layer, the overcoating layer having a thickness between about 0.05 micrometer and about 0.3 micrometer and comprising from about 0.5 percent to about 3 percent by weight nigrosine, and heating the photoconductive insulating layer until only the selenium in the layer adjacent the substrate crystallizes to form a continuous substantially uniform crystalline layer having a thickness up to about one micrometer.

13 Claims, No Drawings

SELENIUM ALLOY IMAGING MEMBER

BACKGROUND OF THE INVENTION

The present invention relates in general to electrophotographic imaging members and processes for preparing the members.

A common technique for manufacturing xeroradiographic photoreceptor plates involves vacuum deposition of an amorphous selenium alloy layer having a thickness of about 150 microns onto an aluminum substrate at about 75° C. (167° F.). The deposited selenium alloy layer is usually free of crystalline selenium. These xeroradiographic plates require a moderate amount of x-ray dosage to expose the plates after they have been uniformly electrostatically charged.

PRIOR ART STATEMENT

W. D. Fender, *Quantification of the Xeroradiographic discharge curve,* SPIE Vo. 70 (1975) 364—Amorphous selenium alloy photoreceptors are disclosed having a thickness of 120 to 300 micrometers. These photoreceptors were doped with both arsenic and chlorine.

L. S. Jerome et al, *Process Studies On Higher Sensitivity Xeromammography,* SPIE Vo. 555 Medical Imaging and Instrumentation '85 (1985) 127—An experimental photoreceptor is disclosed having a thickness of 320 micrometers.

R. C. Speiser et al, *Dose Comparisons For Mammographic Systems,* Med. Phys. 13 (5), Sept./Oct. 1986 667—A selenium photoreceptor is disclosed having a thickness of 320 micrometers.

In U.S. Pat. No. 4,298,671 to Kassel et al an electrophotographic recording material is disclosed comprising a layer of amorphous selenium and a layer of crystalline selenium. The device consists of an electrically conductive substrate, upon which is vapor-deposited a thin layer of tellurium. A layer of crystalline selenium is deposited on the tellurium layer and then a layer of amorphous selenium is deposited on the crystalline selenium layer. In a specific example, selenium is deposited at a rate of 1 micrometer/min until a thickness of 60 micrometers is attained. The previously deposited tellurium causes a 0.3 to 3 micrometer layer of crystallized selenium to form. Various crystallization techniques are described in the background of the invention. The photoreceptor of Kassel et al requires multiple layers of photoconductive material and is designed for monopolar carrier transport.

In U.S. Pat. No. 4,098,655 to Ward et al a method is disclosed for fabricating a photoreceptor wherein the photoreceptor substrate initially has a thin electrically insulating oxide layer on its surface. A selenious acid is applied to the oxide layer, thereby dissolving the oxide layer and forming a thin selenium layer. Depending on the chemical process and temperature involved, this thin selenium layer may be amorphous, trigonal (or crystalline) or a mixture of the two forms. A typically 10 to 60 micrometer thick photoconductive insulating layer of selenium alloy may be vacuum-deposited onto the thin selenium layer or a charge carrier transport layer may be deposited onto the thin selenium layer. The photoreceptor of Ward et al employs a cumbersome wet chemical process for forming a crystalline layer and therefore is not compatible with mass production requirements.

In U.S. Pat. No. 3,973,960 to Dulken et al an electrophotographic element is disclosed comprising an arsenic-selenium alloy containing a concentration gradient of arsenic. The concentration gradient decreases from the exposed surface of the selenium layer. The total arsenic content of the layer ranges from 1 to 20 percent, with the arsenic concentration at the free surface being at least 13 percent. The layer may also contain from 1 to 10,000 ppm halogen. In one working example, the alloy deposition process was about 50 minutes long with the crucible temperature being increased from 260° C. (500° F.) to 290° C. (554° F.) while the drum temperature was about 85° C. (185° F.) to form a layer of about 50 micrometers. In another working example, the alloy deposition process was about 50 minutes long with the crucible temperature being increased from 325° C. (617° F.) to 360° C. (680° F.) while the drum temperature was about 170° C. (338° F.) to form a layer of about 50 micrometers. The photoreceptor of Dulken et al can contain high levels of arsenic in excess of 2 percent which can cause reticulation, a wrinkling of the top surface of the photoreceptor. Moreover, the high arsenic photoreceptor of this patent is prepared using high preparation temperatures.

In U.S. Pat. No. 4,126,457 to Ciuffini a method for producing a flexible photoreceptor is disclosed wherein the photoreceptor comprises a selenium alloy layer containing a concentration gradient of arsenic. The concentration gradient is produced by evaporating and condensing selenium alloys onto a flexible substrate in a profile of increasing arsenic concentration while maintaining the temperature of the substrate or interface-substrate at no less than the glass transition temperature of the selenium alloy of lowest arsenic concentration and not less than about 85° C. The alloy may also contain 0 to 10,000 ppm halogen. In one working example, three different alloys were sequentially heated for 21 minutes each at progressively higher temperatures of 300° C., 380° C. and 420° C. while the substrate temperature was maintained at 85° C. In another working example, the alloy was evaporated at 420° C. for 60 minutes. It appears that the thickness of the alloy layers deposited in the working examples was about 60 micrometers. The photoreceptor of Ciuffini, like Dulken et al, can contain high levels of arsenic which can cause reticulation, a chronic failure mode of thermally relaxed selenium x-ray photoreceptors.

In U.S. Pat. No. 4,008,082 to Beschoner et al a method for producing an electrophotographic recording material is disclosed wherein a thin layer of an arsenic-selenium alloy is vapor-deposited while the substrate is held at a temperature above the glass transformation temperature of the alloy. The remaining desired thickness of the alloy is then vapor-deposited onto the first layer at a substantially lower substrate temperature. The transformation temperature is defined as that temperature at which glass has a viscosity of $10^{13.4}$ poises. For example, the first deposited layer can have a thickness of about 0.1 to 2.0 micrometers and the thickness of the second layer is variable within a broad range. Specific examples describe first layer thicknesses of about 1 micrometer and second layer thicknesses of 10 or 9 micrometers. The rate at which the substrate temperature is reduced after the deposition of the first partial layer is about half an hour. The process of Beschoner et al uses a high substrate deposition temperature of 125° C. (257° F.).

In U.S. Pat. No. 4,277,551 to Sonnonstine et al an electrophotographic element is disclosed comprising a substrate, a photoconductive-insulative layer and an organic electron transport overlayer. The photoconductive-insulative layer comprises a selenium-arsenic alloy containing 90 to 97.5 atomic percent selenium and can have a thickness in the range of 40 to 100 micrometers. The organic electron transport overlayer is employed to prevent crystallization of the photoconductive-insulative layer. Like Kassel et al described above, Sonnonstine et al requires multiple layers of photoconductive material and is designed for monopolar carrier transport.

In U.S. Pat. No. 4,011,079 to Berle et al a method is disclosed for producing an electrophotographic recording material by vapor-deposition of selenium or selenium alloy onto a carrier at a temperature below the glass transformation temperature and then heating the vapor-deposited layer to a temperature between the glass transformation temperature and a temperature just below that at which the electrophotographic properties change. The temperatures are selected so crystallization is not allowed to occur.

Generally, prior xeroradiographic photoreceptors exhibit deficiencies such as low x-ray sensitivity, absence of provisions for blotch or fatigue elimination, monopolarity, non-imageability to the edge of the photoreceptor, and high defect levels due to the crucible and substrate temperatures employed during fabrication. Many photoreceptors are intended to perform in line copiers and are characterized by features that are unsuitable for high sensitivity x-ray systems. Thus, for example, a monopolar photoreceptor cannot meet the bipolar (hole and electron) transport requirements necessary to achieve high x-ray sensitivity.

Photoreceptors containing non-crystalline selenium at the substrate interface tend to exhibit blotch. When blotching occurs, it appears as mottling similar to the grain pattern of the aluminum substrate or the pattern of linen fabrics with fine crisscrossing lines. Monopolar high arsenic (or high chlorine) photoreceptors tend to exhibit low x-ray sensitivity and therefore do not compete in the present day screened film market. Photoreceptors having high top surface arsenic concentrations tend to exhibit reticulation, a catastrophic wrinkling of the top surface. Photoreceptor generally cannot image to the edge, a critical requirement for mammography, when they do not carry a selenium coating to the edge. Many photoreceptors exhibit fatigue and unacceptable defects because they are overcoated with highly insulating overcoatings. Photoreceptors without properly cleaned substrates also tend to exhibit unacceptable defect levels and fatigue as well.

Thus, there is a need for an improved xeroradiographic imaging member and process for preparing the member.

SUMMARY OF THE INVENTION

Accordingly, it is an object of the present invention to provide an improved electrophotographic imaging member and process for preparing the imaging member which overcomes the problems encountered with electrophotographic imaging members of the prior art.

It is a further object of the present invention to provide an improved electrophotographic imaging member which reproduces a continuous grey scale imaging receptor from 0 volts to the full charge potential under rapid image cycling conditions.

It is a further object of the present invention to provide an improved electrophotographic imaging member which provides greater resolution at a significantly reduced X-ray dosage of previous xeroradiographic imaging members.

It is a further object of the present invention to provide an improved electrophotographic imaging member which provides resolution comparable or superior to current X-ray photographic films.

It is a further object of the present invention to provide an improved electrophotographic imaging member which exhibits reduced fatigue during cycling.

It is a further object of the present invention to provide an improved electrophotographic imaging member which exhibits allows imaging to the edge of the photoreceptor surface.

It is a further object of the present invention to provide an improved electrophotographic imaging member which exhibits less reticulation during cycling.

It is a further object of the present invention to provide an improved electrophotographic imaging member which exhibits less blotch during cycling.

It is a further object of the present invention to provide an improved electrophotographic imaging member which minimizes electrical defects such as powder deficient spots in positive imaging and powder excess spots in negative imaging.

It is a further object of the present invention to provide an improved electrophotographic imaging member which exhibits greater x-ray sensitivity than prior x-ray sensitive photoreceptors.

It is a further object of the present invention to provide an improved process for fabricating, with reasonable yields, an electrophotographic imaging member having extended grey scale capabilities.

The above objects and others are accomplished in accordance with the present invention by providing an electrophotographic imaging member comprising providing a conductive substrate and an alloy layer comprising selenium doped with arsenic and chlorine having a thickness of between about 100 micrometers and about 400 micrometers, the alloy layer comprising between about 0.1 percent and about 2 percent by weight arsenic at the surface of the alloy layer facing away from the conductive substrate and comprising crystalline selenium having a thickness of from about 0.01 micrometer to about 1 micrometer contiguous to the conductive substrate. The alloy selenium layer is coated with a thin protective overcoating layer on the alloy layer, the overcoating layer having a thickness between about 0.05 micrometer and about 0.3 micrometer and comprising from about 0.5 percent to about 3 percent by weight nigrosine.

The process for preparing a photoreceptor of this invention comprises providing a conductive substrate, cleaning the substrate, heating an alloy comprising selenium and from about 0.05 percent to about 2 percent by weight arsenic until from about 2 percent to about 90 percent by weight of the selenium in the alloy is crystallized, vacuum depositing the alloy on the substrate to form a vitreous photoconductive insulating layer having a thickness of between about 100 micrometers and about 400 micrometers containing between about 0.2 percent and about 2 percent by weight arsenic at the surface of the photoconductive insulating layer facing away from the conductive substrate, and heating the photoconductive insulating layer until only the selenium in the layer adjacent the substrate crystallizes to form a continuous substantially uniform crystalline layer having a thickness up to about one micrometer. A thin protective overcoating layer is applied on the photoconductive insulating layer having a thickness between about 0.05 micrometer and about 0.3 micrometer.

The substrate may be an opaque metal such as aluminum and may comprise numerous suitable materials having the required mechanical properties and an electrically conductive surface. The entire substrate may comprise the same material as that in the electrically conductive surface or the electrically conductive surface may merely be a coating on the substrate. Any suitable electrically conductive material may be employed. Typical electrically conductive materials include, for example, aluminum, titanium, nickel, chromium, brass, copper, zinc, silver, tin and the like. The conductive layer may vary in thickness over substantially wide ranges depending on the desired use of the electrophotoconductive member. Accordingly, the conductive layer may generally range in thickness from about 50 Angstrom units to several centimeters. The substrate may comprise any other conventional material including organic and inorganic materials. Typical substrate materials include insulating non-conducting materials such as various resins known for this purpose including polyesters, polycarbonates, polyamides, polyurethanes, and the like. The coated or uncoated substrate having an electrically conductive surface may have any number of configurations such as, for example, a plate, a cylindrical drum, a scroll, and the like.

The outer surface of the supporting substrate adjacent to the photoconductive layer should normally comprise a metal oxide such as aluminum oxide, nickel oxide, titanium oxide, and the like. An aluminum substrate having a thickness of between about 250 micrometers (10 mils) and about 6,000 micrometers (¼ inch) with an insulating layer of aluminum oxide having a thickness of between about 10 Angstroms and about 1,000 Angstroms is preferred to provide an electron injection barrier layer and to thereby minimize electrical defects in the selenium coating. Although an oxide of aluminum naturally forms on aluminum exposed to the atmosphere, the oxide layer may contain imperfections. Imperfections are minimized by careful cleaning and controlled oxidation.

Any suitable cleaning material capable of providing a defect-free photoreceptor interface may be employed. Typical substrate cleaning compositions include Oakite NSS cleaner (available from Oakite Products, Inc., New Jersey), water, sodium carbonate, trisodium phosphate caustic bath, nitric acid bath and the like. When caustic or acid baths are employed, the surface of the substrate is preferably prepared rinsed with deionized water. Thus, for example, the substrate may be treated to a nitric acid dip followed by a deionized water rinse at about 93° C. (200° F.). Further cleaning and oxidation of the substrate may be accomplished by glow discharge treatment of the substrate in the vacuum coater. Formation of the aluminum oxide layer can be closely monitored and controlled by regulation of a coater bleed gas flow rate with a precision flow gauge and valve. Pressure should be maintained between about 10 and about 100 micrometers of mercury. The substrate temperature should be less than about 115° C. (240° F.) and flow rate should be sufficient to a maintain a high oxygen content atmosphere (about 21 percent for air).

In some cases, intermediate adhesive layers between the metal oxide surface and subsequently applied photoconductive layers may be desirable to improve adhesion. If such adhesive layers are utilized, they preferably have a dry thickness between about 0.1 micrometer to about 5 micrometers. Typical adhesive layers include et. al. film-forming polymers such as polyester, polyvinylbutyral, polyvinylpyrolidone, polyurethane, polymethylmethacrylate, and the like and mixtures thereof.

The photoconductive selenium-arsenic alloy layer should be prepared from a starting alloy composition (alloy prior to deposition) comprising between about 0.05 percent by weight and about 2 percent by weight arsenic and a halogen selected from the group consisting of up to about 25 parts per million by weight of chlorine with the remainder being selenium. The expression "selenium-arsenic alloy" is intended to include halogen doped alloys as well as alloys not doped with halogen. Optimum x-ray sensitivity, x-ray absorption and maximum bi-polar carrier transport efficiency, are achieved with selenium-arsenic alloy layers containing between about 0.2 percent and about 0.5 percent by weight arsenic and between about 5 to about 25 parts per million by weight chlorine with the remainder being selenium. The preferred halogen is chlorine. Concentrations of arsenic exceeding about 2 percent by weight lead to excessive hole trapping and concentrations of arsenic less than about 0.05 percent by weight result in crystallization due to thermal relaxation. As the chlorine content rises above about 25 parts per million by weight chlorine, the photoreceptor begins to exhibit excessive electron trapping. The selenium-arsenic alloy photoconductive layer can be prepared by thermal blending of the selenium-arsenic alloy shot and chlorine doped selenium to obtain the desired dopant levels. The selenium shot is then treated in a Munsen blender to induce crystallinity and allowed to age under applied heat.

The selenium-arsenic alloy may be at least partially crystallized by placing the selenium alloy in shot form in a crucible in a vacuum coater and heated to between about 93° C. (200° F.) and about 177° C. (350° F.) for between about 20 minutes and about one hour to increase crystallinity and avoid reticulation. Preferably, the selenium-arsenic alloy material is shot form is heated until from about 2 percent to about 90 percent by weight of the selenium in the alloy is crystallized. The selenium-arsenic alloy material shot may be crystallized completely prior to vacuum deposition to ensure that a uniform starting point is employed. However, if desired, a completely amorphous alloy may used as the starting material for vacuum deposition.

The selenium-arsenic alloy may be vacuum deposited onto the metallic substrate using a conventional vacuum coating apparatus having the crucible array exposed alloy surface area minimized in order to maximize evaporation rate thereby controlling arsenic fractionation to within acceptable limits. The maximum exposed alloy surface area varies with deposition conditions such as temperature, distance between crucible and substrate, etc., but can be determined experimentally, for example, by conducting multiple runs with a reduction of the exposed alloy surface area on each successive run until analysis of the top surface concentration of the deposited selenium alloy layer reveals an arsenic concentration of less than about 2 percent by weight. The selenium alloy shot in the crucibles in the vacuum coater is evaporated using a time/temperature schedule designed to minimize the fractionation of the alloy during evaporation. Thus, the percentage of arsenic in the starting selenium alloy shot is substantially the same as the percentage of arsenic in the deposited alloy layer within the specified 0.05 to 2 percent limits. Maintaining the arsenic concentration between about 0.3 percent and about 2 percent by weight and the chlorine concentration below about 20 parts per million throughout the selenium alloy thickness facilitates both hole and electron transport for high x-ray sensitivity. This bipolar characteristic of the alloy layer means that two carriers, electrons and holes are free to move within the bulk of the alloy layer but may not necessarily be injected across the substrate or top surface interfaces. In a typical crucible evaporation program, the alloy layer is formed in about 20 to about 120 minutes during which time the crucible temperature is increased from about 221° C. (430° F.) to about 287° C. (550° F.) and the substrate is maintained at a temperature of between about 74° C. (165° F.) and about 80° C. (176° F.). Chamber pressure during evaporation is in the order of of less than about $8\times10^{-5}$ Torr. The amount of alloy present in the crucibles will depend upon the specific coater configuration and other process variables but will be calibrated to yield the desired thickness. Satisfactory results may be achieved with a selenium-arsenic alloy photoconductive alloy layer having between about 0.1 percent and about 2 percent by weight arsenic at the surface of the photoconductive insulating layer facing away from the conductive substrate and a thickness between about 100 micrometers and about 400 micrometers. Levels of arsenic exceeding about 2 percent can lead to reticulation, a catastrophic wrinkling of the surface of the photoconductive insulating layer facing away from the conductive substrate. Such wrinkling can render the imaging member unsuitable for applications which require highly detailed and precise images such as mammograms. A selenium-arsenic alloy layer having a thickness greater than about 400 micrometers generally results in excessive defect levels and charging (or low contrast) potentials. Thicknesses less than about 100 micrometers tend to exhibit photon shot noise from limited x-ray absorption. Optimum results are achieved with alloy layers having a thickness between about 280 micrometers and about 340 micrometers.

Preferably, the selenium-arsenic alloy layer is deposited to the very edge of the substrate to facilitate mammographic imaging further into the chest wall region of the patient. Edge deposition is achieved by use of a mask which prevents selenium from entering the mandrel interior while providing a uniform rounded selenium deposit at the edge of the photoreceptor which does not bridge to the mask.

The deposited selenium-arsenic is annealed after coating at a temperature below the glass transition temperature of the alloy layer. Annealing is conducted at a temperature of between about 43° C. (109° F.) and about 49° C. (120° F.) for a period of between about 36 hours and about 54 hours.

When-blotching occurs, it appears as mottling and is similar to the grain pattern of the aluminum substrate or the pattern of linen fabrics, with fine crisscrossing lines. The annealing process causes a fine layer of crystalline selenium from about 10 angstroms to about 1,000 angstroms in thickness to form at the aluminum oxide selenium interface. This crystalline layer forms an added electron injection blocking layer which eliminates the blotch effect. Heat thermally relaxes the layer to reduce fatigue defects and ghost imaging and permits achievement of continual gray scale imaging from 0 volts to the full charge potential.

Any suitable continuous overcoating may be employed. The overcoating should have a thickness of between about 0.05 micrometer to about 0.3 micrometer. A thin protective overcoating layer having a thickness between about 0.05 micrometer and about 0.2 micrometer is preferred because overcoating abrasion resistance life is low below about 0.1 micrometer and residual charge build up and reduced resolution occurs above about 0.2 micrometer. Any suitable film forming resin may be employed in the overcoating. Typical film forming resins include polyester, polyurethane, polyvinylidene chloride, polysiloxane, polymethyl methacrylate and trimethylammonium chloride, and the like and mixtures thereof. Additives may also be added to the overcoating. These additives may be incorporated into the overcoating to render it slightly more electrically conductive, e.g. to achieve a resistivity of between about $10^{12}$ ohm cm to about $10^{14}$ ohm cm. The overcoating should contain from about 0.5 percent to about 3 percent by weight nigrosine, based on the total weight of the overcoating to provide transverse electrical conductivity of the overcoating and to eliminate fatigue. Optimum results are obtained with an overcoating comprising a mixture of about 0.6 percent to about 0.8 percent by weight nigrosine, about 45 percent to about 55 percent by weight polyester resin, about 25 percent to about 35 percent by weight polyvinylidene chloride, and about 10 percent to about 20 percent by weight polyurethane, based on the total weight of the overcoating. Since the photoreceptor overcoating is applied to the extremes of two opposite edges coated with photoconductive material (the other two edges forming borders that are free of photoconductive material), the photoreceptor plate is coated with the imaging surface in a vertical orientation with the opposite edges of the photoreceptor bearing a photoconductive coating also in a vertical orientation (the other two edges of a square photoreceptor will, of course, be horizontal) to avoid flow of the coating material toward the vertical edges. Flow of the coating material to a horizontally orientated edge coated with photoconductive material tends to form a bead of overcoating material which causes an undesirable image artifact during xeroradiographic imaging.

The electrophotographic imaging member of this invention may be employed in conventional cyclic xeroradiographic imaging processes involving repeated uniform charging, image exposure, development, transfer, erasure and cleaning cycles. However, the performance of the photoreceptors of this invention is significantly superior over prior xeroradiographic imaging members. This difference is illustrated in greater detail in the working examples that follow. Any suitable development technique may be utilized to develop the electrostatic latent image on the electrophotographic imaging member of this invention. Typical well known electrophotographic development techniques include, for example, cascade development, magnetic brush development, liquid development, powder cloud development and the like. The deposited toner image may be transferred to a receiving member by any suitable conventional transfer technique, e.g. electrostatic, tape and the like, and affixed to the receiving member by any suitable well known fixing technique. Cleaning of the photoreceptor to remove any residual toner particles remaining after transfer may be effected by any suitable conventional cleaning technique such as brush cleaning, blade cleaning, web cleaning, moistened foam roll cleaning and the like. Erasure of the electrostatic latent image may also be accomplished by any suitable conventional technique. Typical conventional erase techniques include AC corona discharge, negative corona discharge, illumination from a light source, contact with a grounded conductive brush, thermal relaxation and combinations thereof.

The electrophotographic selenium-arsenic alloy photoreceptors of this invention are x-ray sensitive and are particularly suitable for mammographic, dental and other soft tissue imaging systems. Unlike conventional photoreceptors for high contrast black and white imaging, the unusually thick photoreceptor of this invention reproduces a continuous grey scale image from 0 volts to the full charge potential through thermal relaxation to allow frequent imaging cycles. It also provides greater resolution at approximately half the X-ray dosage of currently commercial xeroradiographic imaging members, provides resolution comparable to or exceeding current X-ray photographic films, and is also similar in x-ray sensitivity to currently commercial x-ray sensitive photographic films. The process of this invention provides an x-ray sensitive photoreceptor having an exceptional gray scale, low artifacts at reasonable yields. The combination, configuration and nature of the manufacturing steps also avoids major defects such as fatigue, reticulation, and blotch.

Fatigue is measured through the use of an additive (nigrosine) in the overcoating which imparts an optimal level of overcoating conductivity. The substrate cleaning process minimizes the formation of interface crystallites where electron injection may occur.

Reticulation is minimized through an alloy treatment process which imparts crystallinity to the alloy either inside or outside the vacuum coater. Reticulation also is minimized by maximizing the crucible array evaporation rate.

Blotch is eliminated through a thermal treatment annealing process step which forms a crystalline layer of selenium at the aluminum oxide/amorphous selenium interface.

Unlike conventional xeroradiographic receptors, the xeroradiographic receptors of this invention will image into the chest wall, due to the unique edge coating process used on this large area mammographic receptor.

The composite device of this invention comprises a unique structure exhibiting improved energy sensing properties with respect to X-radiation. This improved energy sensing property enhances imaging capability including the ability to detect the earliest stages of cancer, such as microcalcifications which are indicative of impending breast cancer.

A number of examples are set forth herein below that are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A control prior art electrophotographic imaging member was prepared by evaporating halogen doped selenium-arsenic alloy shot onto a flat aluminum substrate. The 23 cm (9¼ inch)×36 cm 14¼ inch)×2 mm (0.080 inch) aluminum substrate carried on its outer surface a thin layer of aluminum oxide having a thickness between about 50 Angstroms and about 200 Angstroms. The aluminum oxide layer was cleaned prior to vacuum coating by immersion for 30 seconds in a liquid cleaning bath containing Oakite NSS, a caustic bath comprising trisodium phosphate. The bath was maintained at 52° C. (125° F.)–57° C. (135° F.). The substrate was thereafter removed from the bath and rinsed with water several times, dipped in nitric acid for 30 seconds, and rinsed with a hot deionized water spray rinse. The halogen doped selenium-arsenic alloy shot contained about 0.35 percent by weight arsenic, about 11.5 parts per million by weight chlorine, and the remainder selenium based on the total weight of the alloy. The chlorine doped selenium-arsenic alloy was placed in shot form in a 6 string stainless steel crucible array in a vacuum coater and evaporated at an evaporation temperature of between about 190° C. (375° F.) and about 260° C. (500° F.) and an evaporation pressure between about $2\times10^{-4}$ torr and $1\times10^{-5}$ torr. The substrate temperature was maintained between about 71° C. (160° F.), and about 78° C. (172° F.), during this evaporation coating operation. The selenium alloy top surface arsenic level was maintained below about 4 percent by weight. The selenium alloy was not applied along a 0.3 cm masked border of both long edges of the aluminum substrate and, therefore, did not effectively facilitate mammographic imaging into the chest wall region. The resulting halogen doped selenium-arsenic layer had a conventional xeroradiography layer thickness of about 150 micrometers and contained about 0.34 percent by weight arsenic, about 11.5 parts per million chlorine and the remainder selenium. The halogen doped selenium-arsenic layer was thereafter coated with a coating mixture comprising about 50 percent by weight Polyester resin (PE 200, available from Goodyear Tire & Rubber Company), about 15 percent by weight Vithane resin (available from Goodyear Tire & Rubber Company), about 30 percent by weight polyvinylidene resin (F310, available from Dow Chemical Company) and about 0.3 percent by weight nigrosine (Z1630 available from American Cyanamid Company) by flow coating with the long edge of the substrate held horizontally to form a coating having a thickness of about 0.1 micrometer after drying.

EXAMPLE II

Electrophotographic imaging members were prepared by evaporating halogen doped selenium-arsenic alloy shot onto flat aluminum substrates having dimensions of 23 cm (9¼ in)×36 cm (14¼ in)×2 mm (0.080 in). Each aluminum substrate carried on its outer surface a thin layer of aluminum oxide having a thickness between about 50 Angstroms and about 200 Angstroms. The aluminum substrates were cleaned prior to vacuum coating by immersion in a caustic cleaning bath comprising trisodium phosphate and sodium carbonate held at a temperature of 74° C. (165° F.)–79° C. (175° F.) for 60 seconds followed by a hot deionized water rinse at a temperature of about 100° C. (212° F.). The rinsed aluminum substrates were then exposed to a glow discharge cleaning and oxide formation step within a vacuum coater at an initial pressure of about $29\times10-3$ millimeters of mercury while air was air bled into the coater and the substrate temperature was raised by the glow discharge treatment to about 85° C. (185° F.) to provide a smooth etched aluminum oxide coated photoreceptor layer receiving surface on each substrate. The short edges of the substrate were masked to prevent selenium alloy deposition. Halogen doped selenium-arsenic alloy shot contained about 0.35 percent by weight arsenic, about 11.5 parts per million by weight chlorine, and the remainder selenium, based on the total weight of the alloy was placed in crucibles in a vacuum coater and heat aged at 121° C. (250° F.) for 1 hour to crystallize the selenium in the alloy. After crystallization, the selenium alloy was evaporated from chrome coated stainless steel crucibles at an evaporation temperature of between about 204° C. (400° F.) and about 288° C. (550° F.) and an evaporation pressure between about $4\times10^{-4}$ torr and $2\times10^{-5}$ torr. The substrate temperature was maintained between about 74° C. (165° F.) and about 80° C. (176° F.) during this evaporation coating operation. A selenium alloy coating was applied to both long edges of each aluminum substrate to facilitate mammographic imaging into the chest wall region. Each resulting halogen doped selenium-arsenic layer after a deposition period of about 90 minutes and a gradual cool down period of about 35 minutes had a thickness of about 320 micrometers and contained about 0.33 percent by weight arsenic, about 10 parts per million by weight chlorine and the remainder selenium. Since the selenium-arsenic alloy fractionates, the arsenic moves back from the melt surface. When the crucibles are empty, the high arsenic layer is evaporated onto the top of each photoreceptor. Although the top surface (a few micrometers thick) arsenic concentration may be as high as 2 percent, the mean arsenic concentration of the selenium alloy layer is 0.33 percent. Thus, one third percent of arsenic in the starting selenium alloy shot provides one third percent arsenic in the deposited alloy. To maintain the top surface arsenic concentration below about 2 percent, the exposed surface area of the chrome coated stainless steel crucibles was limited to 5 parallel strings of crucibles. Each string of crucibles had an overall width of 4 inches by 8 feet and comprised 22 depressions along the length of the strip, each depression being about 3 inches wide by about 6 inches long. When 6 or more strings were used, the top surface arsenic concentration exceeded 2 percent. The halogen doped selenium-arsenic layer on each substrate was thereafter coated with a coating mixture comprising about 50 percent by weight polyester resin (PE200, available from Goodyear Goodyear Tire & Rubber Company), about 15 percent by weight polyurethane resin (Vithane, available from Goodyear Goodyear Tire & Rubber Company), about 30 percent by weight polyvinylidene chloride resin (Saran F310, available from Dow Chemical Company) and about 0.6 percent by weight nigrosine (Z-1630 available from American Cyanamid Company) by spraying to form a coating having a thickness of about 0.1 micrometers after drying. The photoreceptors were coated with the imaging surface in a vertical orientation with the opposite long edges of the photoreceptor bearing a photoconductive coating also in a vertical orientation (the other two edges of a square photoreceptor will, of course, be horizontal) to avoid flow of the coating material toward the vertical edges. The deposited selenium arsenic layer was thereafter annealed at a temperature below the glass transition temperature of the alloy layer. Annealing was conducted at a temperature between about 43° C. (109° F.) and about 49° C. (120° F.) for a period of between about 36 hours and about 54 hours.

EXAMPLE III

A photoreceptor was prepared using the procedures and materials described in Example II except that while the halogen doped selenium-arsenic layer was being coated with the overcoating mixture by spraying, the imaging surface was held in a vertical orientation with the opposite short edges of the photoreceptor bearing the photoconductive coating also being in a vertical orientation (the other two long edges of rectangular photorecptor being horizontal). The coating material flowed toward the lower horizontal long edge to form a coating bead. The overcoated photoreceptor was then charged, exposed to an x-ray image and developed with liquid developer. The developed image along the coating bead was obscured by an outline of the bead which is absent when developing photoreceptors overcoated as described in Example II

EXAMPLE IV

A photoreceptor was prepared using the materials and procedures described in Example II except that instead of using the overcoating step of Example II, one half of the imaging side of the selenium arsenic photoreceptor was overcoated with an overcoating solution having the prior art overcoating formulation described in Example I, i.e. a composition comprising about 50 percent by weight Polyester resin (PE 200, available from Goodyear Tire & Rubber Company), about 15 percent by weight Vithane resin (available from Goodyear Tire & Rubber Company), about 30 percent by weight polyvinylidene resin (F310, available from Dow Chemical Company) and about 0.3 percent by weight nigrosine (Z1630 available from American Cyanamid Company) and the other half of the photoreceptor was overcoated with the overcoating composition described in Example II, i.e. comprising about 50 percent by weight polyester resin (PE200, available from Goodyear Tire & Rubber Company), about 15 percent by weight polyurethane resin (Vithane, available from Goodyear Tire & Rubber Company), about 30 percent by weight polyvinylidene chloride resin (Saran F310, available from Dow Chemical Company) and about 0.6 percent by weight nigrosine (Z-1630 available from American Cyanamid Company), the latter overcoating composition differing from the composition of the former by the use of 0.6 percent by weight nigrosine instead of 0.3 percent. Rapid xeroradiographic cycling (1–6 images per hour) of the photoreceptor in powder cloud and liquid development systems revealed a high level of fatique in the photoreceptor on the side coated with the overcoating containing 0.3 percent by weight nigrosine. The side containing 0.6 percent nigrosine in the overcoating was found to be free of fatigue. This experiment was repeated on 8 to 10 occasions using the 0.3 percent by weight prior art nigrosine level and 0.6 percent and higher percentages (between 0.6 percent and 3 percent by weight) on opposite halves of the imaging surface of selenium arsenic photoreceptors. Each time, no fatigue was seen on the high percentage nigrosine side of the photoreceptor while fatigue appeared on the 0.3 percent by weight nigrosine side.

EXAMPLE V

Electrophotographic imaging members were prepared by evaporating halogen doped selenium-arsenic alloy shot onto flat aluminum substrates having dimensions of 23 cm ($9\frac{1}{4}$ in)$\times$36 cm ($14\frac{1}{4}$ in)$\times$2 mm (0.080 in).

Each aluminum substrate carried on its outer surface a thin layer of aluminum oxide having a thickness between about 50 Angstroms and about 200 Angstroms. The aluminum substrates were cleaned prior to vacuum coating by immersion in a caustic cleaning bath comprising trisodium phosphate and sodium carbonate held at a temperature of 74° C. (165° F.)–79° C. (175° F.) for 60 seconds followed by a hot deionized water rinse at a temperature of about 100° C. (212° F.). The rinsed aluminum substrates were then exposed to a glow discharge cleaning and oxide formation step within a vacuum coater at an initial pressure of about $29\times10-3$ millimeters of mercury while air was air bled into the coater and the substrate temperature was raised by the glow discharge treatment to about 85° C. (185° F.) to provide a smooth etched aluminum oxide coated photoreceptor layer receiving surface on each substrate. The short edges of the substrate were masked to prevent selenium alloy deposition. Halogen doped selenium-arsenic alloy shot contained about 0.35 percent by weight arsenic, about 11.5 parts per million by weight chlorine, and the remainder selenium, based on the total weight of the alloy was placed in crucibles in a vacuum coater and heat aged at 121° C. (250° F.) for 1 hour to crystallize the selenium in the alloy. After crystallization, the selenium alloy was evaporated from chrome coated stainless steel crucibles at an evaporation temperature of between about 204° C. (400° F.) and about 288° C. (550° F.) and an evaporation pressure between about $4\times10^{-4}$ torr and $2\times10^{-5}$ torr. The substrate temperature was maintained between about 74° C. (165° F.) and about 80° C. (176° F.) during this evaporation coating operation. A selenium alloy coating was applied to both long edges of each aluminum substrate to facilitate mammographic imaging into the chest wall region. Each resulting halogen doped selenium-arsenic layer after a deposition period of about 90 minutes and a gradual cool down period of about 35 minutes had a thickness of about 320 micrometers and contained about 0.33 percent by weight arsenic, about 10 parts per million by weight chlorine and the remainder selenium. To maintain the top surface arsenic concentration below about 2 percent, the exposed surface area of the chrome coated stainless steel crucibles was limited to 5 parellel strings of crucibles. Each string of crucibles had an overall width of 4 inches by 8 feet and comprised 22 depressions along the length of the strip, each depression being about 3 inches wide by about 6 inches long. The halogen doped selenium-arsenic layer on each substrate was thereafter coated with a coating mixture comprising about 50 percent by weight polyester resin (PE200, available from Goodyear Goodyear Tire & Rubber Company), about 15 percent by weight polyurethane resin (Vithane, available from Goodyear Goodyear Tire & Rubber Company), about 30 percent by weight polyvinylidene chloride resin (Saran F310, available from Dow Chemical Company) and about 0.6 percent by weight nigrosine (Z-1630 available from American Cyanamid Company) by spraying to form a coating having a thickness of about 0.1 micrometers after drying. The photoreceptors were coated with the imaging surface in a vertical orientation with the opposite long edges of the photoreceptor bearing a photoconductive coating also in a vertical orientation (the other two edges of a square photoreceptor will, of course, be horizontal) to avoid flow of the coating material toward the vertical edges. One of the prepared photoreceptors was charged, exposed to a xeroradiographic image, and developed. This photoreceptor exhibited blotch. This photoreceptor exhibiting blotch was then cleaned to remove the deposited toner and subjected to a 46° C. (115° F.) environment for 48 hours. After this thermal exposure, the photoreceptor was retested and found to be free of blotch. Variations of this experiment below about 43° C. (109° F.) and higher than about 49° C. (120° F.) with some of the other prepared photoreceptors revealed that excessively long thermal exposure times were required for temperatures below about 43° C. (109° F.) whereas temperatures above 49° C. (120° F.) induced higher growth of defect sites rendering the photoreceptor unaccetable for accurate xeroradiographic use. This 46° C. (115° F.) for 48 hours blotch cure test was repeated on several hundred prepared photoreceptors and found to be effective both in reduced length of treatment time and in effectively eliminating blotch.

EXAMPLE VI

Depth dose profiles were measured using a BR12 Breast Phantom as described by R. C. Speiser et al, *Dose Comparisons For Mammographic Systems,* Med. Phys. 13 (5), Sept./Oct. 1986 667. The entire disclosure of this article is incorporated herein by reference. Comparisons, in terms of the mean glandular dose, were made using the photoreceptor of Example I developed with a powder cloud development system (a Xerox 125 machine) and the photoreceptor of Example II developed with a liquid development system (Xerox 175 machine). The measurements made indicated a factor of 2 reduction in dose using the photoreceptor of Example II in a liquid development system (Xerox 175 machine) compared to using the photoreceptor of Example I developed with a powder cloud development system. For example, the mean glandular dose for a 5 cm breast for the photoreceptor of Example II in a liquid development system was 0.13 rad. The mean glandular dose for a 5 cm breast for the photoreceptor of Example I developed with a powder cloud development system was 0.255 rad.

Comparisions of x-ray sensitivity were also made with various screened films. In terms of the mean glandular dose, film and the photoreceptor of Example II were found to be very comparable in terms of sensitivity as measured by the mean glandular dose. For screened film systems using Min-R film (available from Eastman Kodak Co.), Min-R screen and no grid, the mean glandular dose was 0.15 rad compared to 0.13 rad for the photoreceptor of Example II. For a screened film system using Min-R screen, Ortho-M film (available from Eastman Kodak Co.), and no grid, the mean glandular dose was 0.078 rad.

Although the invention has been described with reference to specific preferred embodiments, it is not intended to be limited thereto, rather those skilled in the art will recognize that variations and modifications made be made therein which are within the scope of the invention and within the scope of the claims.

What is claimed is:

1. An electrophotographic x-ray imaging member comprising a conductive substrate, an alloy layer comprising selenium and arsenic having a thickness of between about 100 micrometers and about 400 micrometers, said alloy layer comprising between about 0.1 percent and about 2 percent by weight arsenic at the surface of said alloy layer facing away from said conductive substrate and crystalline selenium having a thickness of from about 0.01 micrometer to about 1 micrometer contiguous to said conductive substrate, and a thin protective overcoating layer on said alloy layer, said overcoating layer comprising a film forming binder and from about 0.5 percent to about 3 percent by weight nigrosine.

2. An electrophotographic imaging member according to claim 1 wherein said overcoating layer having a thickness between about 0.05 micrometer and about 0.3 micrometer.

3. An electrophotographic imaging member according to claim 1 wherein said alloy layer is doped with between about 5 to about 25 parts per million by weight chlorine.

4. An electrophotographic imaging member according to claim 1 wherein said alloy layer has a thickness between about 280 micrometers and about 340 micrometers.

5. A process for preparing an electrophotographic imaging member comprising providing a conductive substrate having a smooth outer surface, cleaning said outer surface of said substrate, vacuum depositing from a starting alloy composition an alloy comprising selenium and from about 0.05 percent to about 2 percent by weight arsenic onto said outer surface of said substrate to form a vitreous photoconductive insulating layer having a thickness of between about 100 micrometers and about 400 micrometers containing between about 0.1 percent and about 2 percent by weight arsenic at the surface of said photoconductive insulating layer facing away from said conductive substrate, applying a thin protective overcoating layer on said photoconductive insulating layer comprising a film forming binder and from about 0.5 percent to about 3 percent by weight nigrosine, and heating said photoconductive insulating layer until only the selenium in said layer adjacent said substrate crystallizes to form a continuous substantially uniform crystalline layer having a thickness up to about one micrometer.

6. A process for preparing an electrophotographic imaging member according to claim 5 wherein said protective overcoating layer has a thickness between about 0.05 micrometer and about 0.3 micrometer.

7. A process for preparing an electrophotographic imaging member according to claim 5 including maintaining said substrate at a temperature of between about 74° C. and about 80° C. during vacuum deposition of said alloy.

8. A process for preparing an electrophotographic imaging member according to claim 5 including maintaining said photoconductive insulating layer at a temperature of between about 43° C. and about 49° C. for a period of between about 36 hours and about 54 hours.

9. A process for preparing an electrophotographic imaging member according to claim 5 wherein said substrate is a flat plate and said alloy is deposited to at least one edge of said substrate.

10. A process for preparing an electrophotographic imaging member according to claim 9 including spraying said thin protective overcoating layer on said surface of said photoconductive insulating layer facing away from said conductive substrate while said surface of said photoconductive insulating layer facing away from said conductive substrate and said edge to which said alloy is deposited are maintained in a vertical orientation.

11. A process for preparing an electrophotographic imaging member according to claim 5 including heating said alloy prior to said vacuum depositing of said alloy until from about 2 percent to about 90 percent by weight of said selenium in said alloy is crystallized.

12. A process for preparing an electrophotographic imaging member according to claim 5 including evaporating said alloy comprising selenium and from about 0.05 percent to about 2 percent by weight arsenic from a molten alloy bath while sufficiently constraining the exposed surface area of said molten alloy to maintain said arsenic in said surface of said photoconductive insulating layer facing away from said conductive substrate to less than about 2 percent by weight.

13. A process for preparing an electrophotographic imaging member comprising providing an alloy comprising selenium and arsenic, heating said alloy to between about 93° C. and about 177° C. to at least partially crystallize said alloy, providing a conductive substrate having a smooth outer surface, cleaning said outer surface of said substrate, vacuum depositing said alloy onto said outer surface of said substrate to form a vitreous photoconductive insulating layer having a thickness of between about 100 micrometers and about 400 micrometers containing between about 0.3 percent and about 2 percent by weight arsenic at the surface of said photoconductive insulating layer facing away from said conductive substrate, applying a thin protective overcoating layer on said photoconductive insulating layer comprising a film forming binder and from about 0.5 percent to about 3 percent by weight nigrosine, and heating said photoconductive insulating layer until only the selenium in said layer adjacent said substrate crystallizes to form a continuous substantially uniform crystalline layer, said continuous substantially uniform crystalline layer having a thickness up to about one micrometer.

* * * * *